US009162125B1

(12) United States Patent
McBryde

(10) Patent No.: US 9,162,125 B1
(45) Date of Patent: Oct. 20, 2015

(54) MULTI-USE GOLF TOWEL

(71) Applicant: Bernie G. McBryde, Topeka, KS (US)

(72) Inventor: Bernie G. McBryde, Topeka, KS (US)

( * ) Notice: Subject to any disclaimer, the term of this patent is extended or adjusted under 35 U.S.C. 154(b) by 381 days.

(21) Appl. No.: 13/850,952

(22) Filed: Mar. 26, 2013

(51) Int. Cl.
*A47L 13/12* (2006.01)
*A63B 57/00* (2015.01)
*A46B 15/00* (2006.01)

(52) U.S. Cl.
CPC ..... *A63B 57/0087* (2013.01); *A46B 15/00* (2013.01); *A47L 13/12* (2013.01)

(58) Field of Classification Search
CPC ..... A47L 13/12; A46B 9/06; A46B 15/00; A46B 57/0087; B05C 17/02; B05C 17/0235
See application file for complete search history.

(56) References Cited

U.S. PATENT DOCUMENTS

| | | | | | |
|---|---|---|---|---|---|
| 3,350,736 | A | * | 11/1967 | Williams et al. | 15/113 |
| 4,953,603 | A | * | 9/1990 | Holden | 150/154 |
| 5,075,918 | A | * | 12/1991 | Zeltner et al. | 15/210.1 |
| 5,230,117 | A | * | 7/1993 | Johnson et al. | 15/106 |
| D339,496 | S | * | 9/1993 | Corcoran | D6/608 |
| 5,331,705 | A | * | 7/1994 | Melov | 15/118 |
| 5,761,761 | A | * | 6/1998 | An | 15/209.1 |
| 2001/0037542 | A1 | | 11/2001 | Elliott | |
| 2012/0272467 | A1 | * | 11/2012 | Forbes | 15/114 |

* cited by examiner

*Primary Examiner* — Robert Scruggs
(74) *Attorney, Agent, or Firm* — Crossley Patent Law

(57) ABSTRACT

A multi-use golf towel including an absorbent front layer, a back layer being chamois, and a moisture barrier inner layer disposed therebetween to keep the front layer dry, a removable rotating golf brush with wire and nylon bristles disposed in a frame within the towel, and a ring to accept a hanging device to attach the towel to a golf bag. A cover disposed on a back side of the frame to protect the bristles.

7 Claims, 3 Drawing Sheets

MULTI-USE GOLF TOWEL

BACKGROUND OF THE INVENTION

Various types of golf towels are known in the attached prior art. However, what is needed is a multi-use golf towel having a front layer for washing and a back layer for drying and polishing, the first and second layers separated by a moisture barrier inner layer. The towel has a removable rotating golf brush with wire and nylon bristles. A ring is provided to suspend the towel from a golf bag. The towel is designed to eliminate the need for multiple attachments and devices used by a golfer. The towel enables the user to quickly and easily clean and dry any and all of his golf equipment.

FIELD OF THE INVENTION

The present invention relates generally to the field of towels, and more particularly, to a multi-use golf towel with a removable rotating brush.

SUMMARY OF THE INVENTION

The general purpose of the present multi-use golf towel, described subsequently in greater detail, is to provide a multi-use golf towel which has many novel features that result in a multi-use golf towel which is not anticipated, rendered obvious, suggested, or even implied by prior art, either alone or in combination thereof.

To accomplish this, the present multi-use golf towel eliminates the need for multiple golf cleaning accessories. The towel has an absorbent front layer, a back layer being a chamois, and a moisture barrier inner layer disposed therebetween. The front layer is used to dry golf balls, club heads, and other items, such as a golf cart seat. The back layer is used to clean and wash a golf club grip, a club head, and a golf ball. The inner layer prevents water on the chamois back layer from permeating the absorbent front layer, thus maintaining the front layer in a dry condition. A frame is disposed within the towel and a brush, with wire bristles on one side and soft bristles on the other side, is removably rotatably disposed within the frame thereby providing two different surfaces for cleaning golf accessories. A cover, which is disposed on the frame bottom side, protects bristles as well as a user's hands during use by providing a gripping area while using the brush.

Thus has been broadly outlined the more important features of the present multi-use golf towel so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
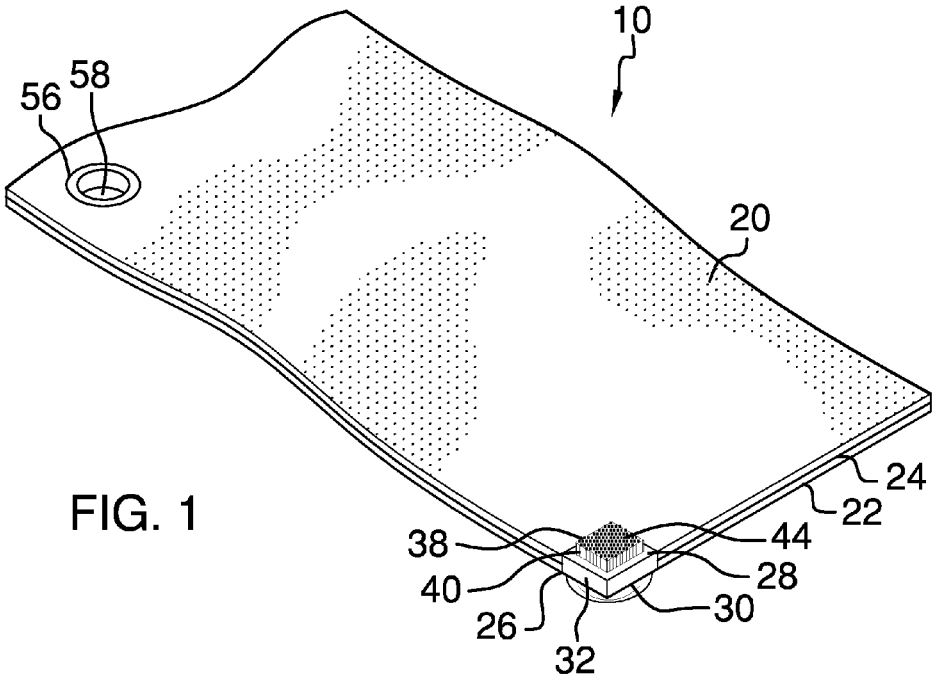
FIG. 1 is a top isometric view.
Figure 2:
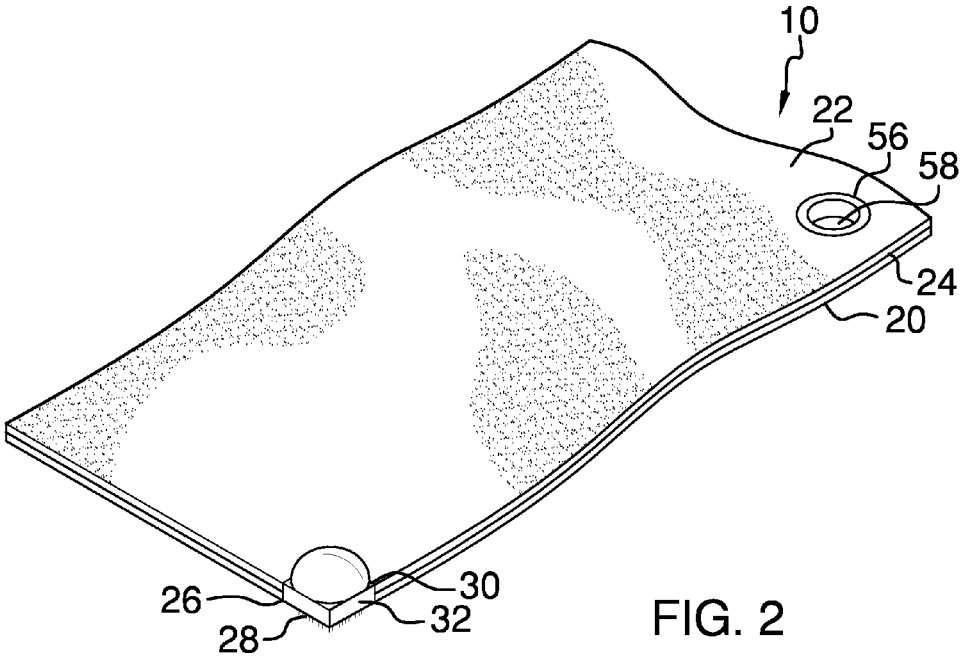
FIG. 2 is a bottom isometric view.
Figure 3:
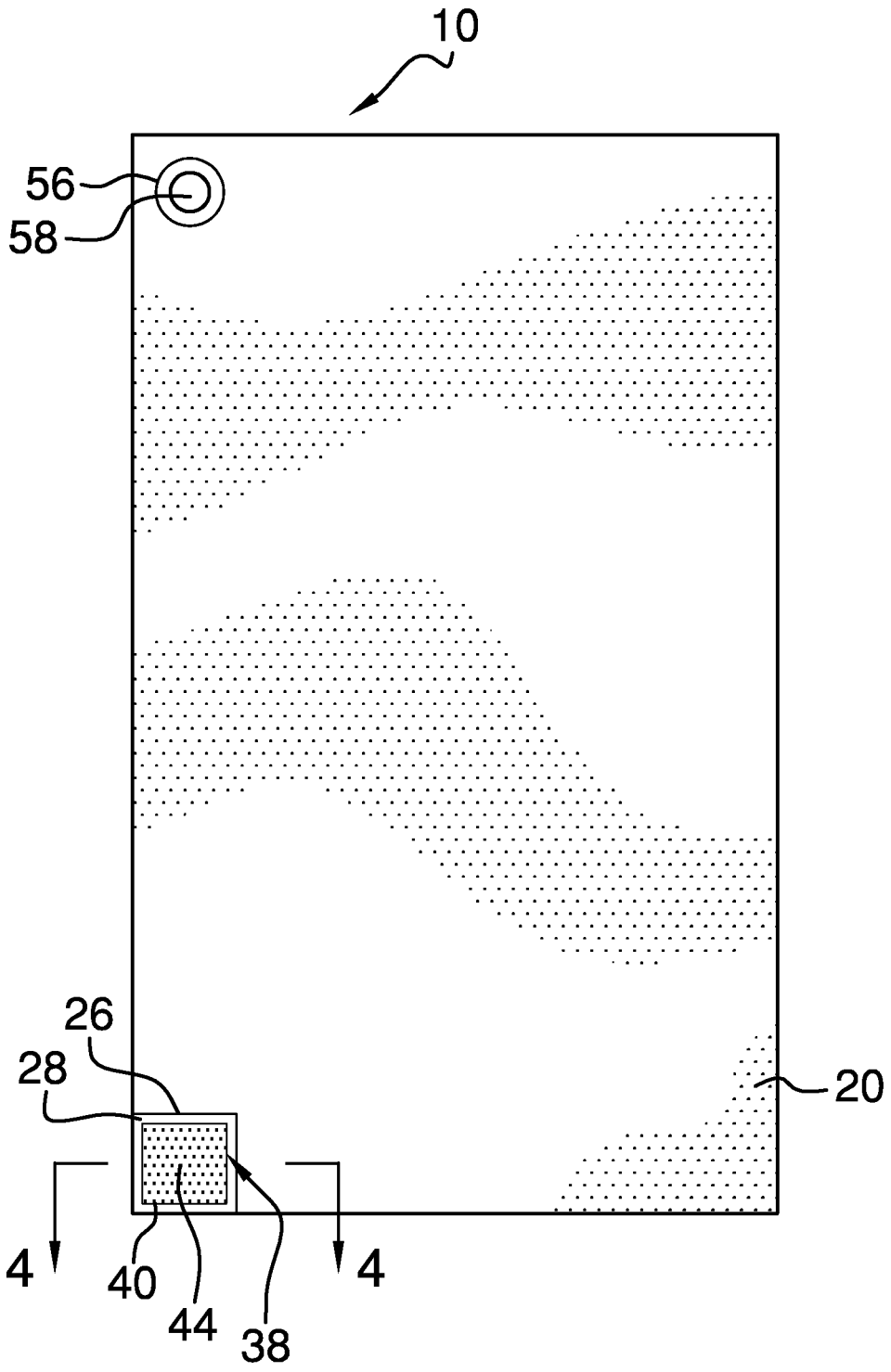
FIG. 3 is a top plan view.
Figure 4:
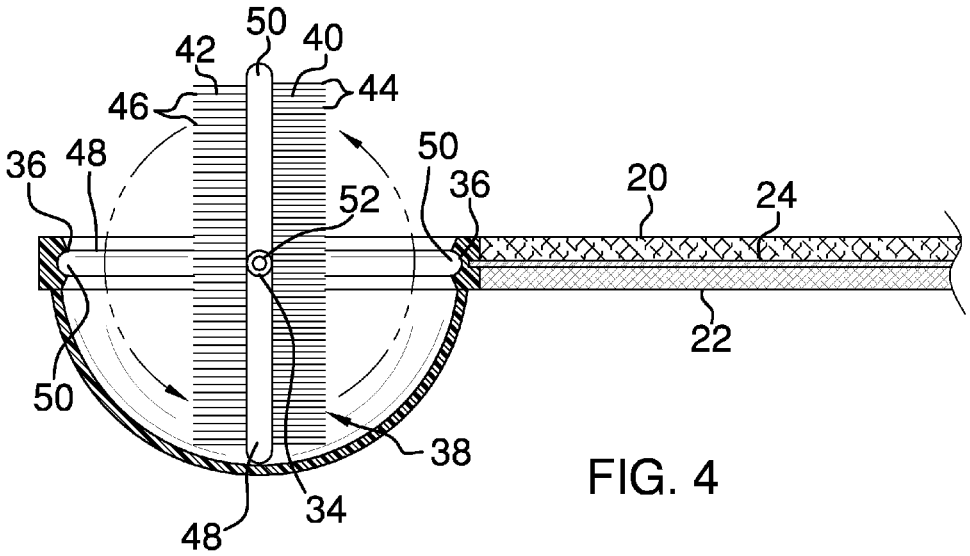
FIG. 4 is a cross sectional view taken along line 4-4 of FIG. 3.
Figure 5:
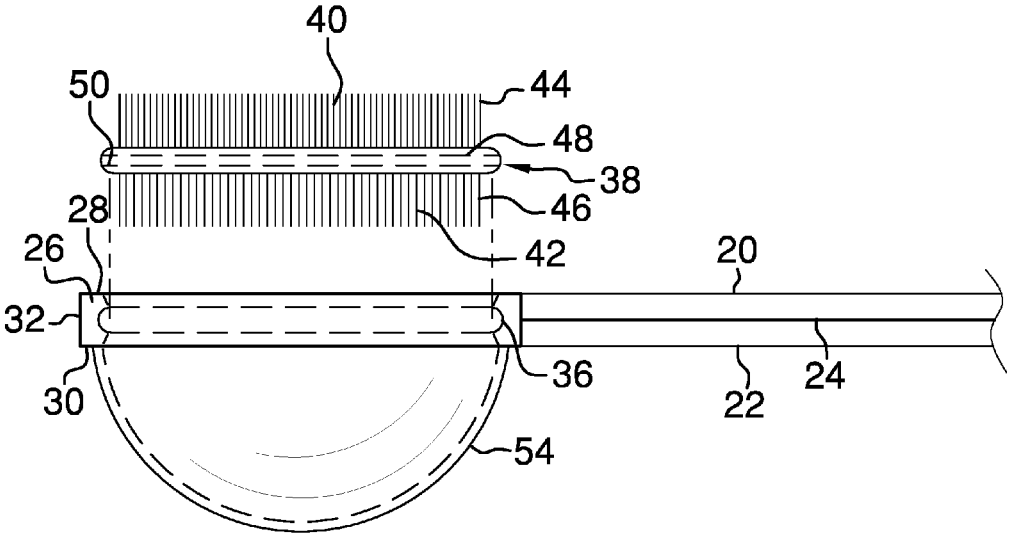
FIG. 5 is an exploded view showing a brush removed from a frame.

With reference now to the drawings, and in particular FIGS. 1 through 5 thereof, an example of the instant multi-use golf towel employing the principles and concepts of the present multi-use golf towel and generally designated by the reference number 10 will be described.

Referring to FIGS. 1 through 5, the present multi-use golf towel 10 to eliminate the need for multiple golf cleaning accessories is illustrated. The multi-use golf towel 10 includes an absorbent front layer 20, a back layer being a chamois 22, and a moisture barrier inner layer 24 disposed therebetween.

A frame 26 is disposed between layers within the towel 10. The frame 26 has a top side 28 disposed on the front layer 20, a bottom side 30 disposed on the back layer 22 and an outer perimeter 32. At least one axle 34 centrally disposed within the frame 26.

A brush 38 is removably rotatably attached within the frame 26. The brush 38 includes a first side 40 and a second side 42 opposite the first side 40. The first side 40 and the second side 42 are alternately exposed on the front layer 20. The brush 38 has a plurality of wire bristles 44 disposed on the entire first side 40 and a plurality of soft bristles 46 disposed on the entire second side 42. A central pivot rod 48 of the brush 38 is disposed between the first side 40 and the second side 42 of the brush 38. A pair of diametrically disposed indents 36 is disposed within the outer perimeter 32 of the frame 26. The central pivot rod 48 has a pair of outer ends 50, which securingly engage the indents 36. The axle 34 rotatingly engages a central aperture 52.

The towel 10 also includes a cover 54 disposed on the bottom side 30. The cover 54 is provided to protect the wire bristles 44 and the soft bristles 46 and to protect a user's hands during use by providing a gripping area while using the wire bristles 44 and alternately, the soft bristles 46.

The multi-use golf towel 10 also has a ring 56 circumferentially bordering a central hole 58 therein to suspend the towel 10 from a golf bag, for example. The ring 56 is continuously disposed through the front, back, and inner layers 20, 22, 24 of the towel 10. The ring 56 provides structural strength to the towel by preventing fraying around the central hole 58.

What is claimed is:

1. A multi-use golf towel comprising:

a multi-layer towel comprising a front layer, a back layer, and a moisture barrier inner layer disposed therebetween;

a frame attached within the towel, the frame comprising:

a frame top side disposed on the front layer;

a frame back side disposed on the back layer;

an outer perimeter;

at least one axle centrally disposed within the frame;

a pair of diametrically disposed indents disposed within the outer perimeter;

a brush removably rotatably within the frame;

a first side of the brush;

a second side of the brush opposite the first side;

wherein the brush first side and the brush second side are alternately exposed on the front layer.

2. The multi-use golf towel of claim 1 further comprising:

a central pivot rod of the brush disposed between the first side and the second side of the brush, the central pivot rod having a pair of outer ends securingly engaging the indents and a central aperture rotatingly engaging the axle.

3. The multi-use golf towel of claim 2 further comprising:

a cover disposed on the frame back side.

4. The multi-use golf towel of claim 2 further comprising:

a plurality of wire bristles disposed on the entire first side; and a plurality of soft bristles disposed on the entire second side.

5. The multi-use golf towel of claim 4 further comprising:

a cover disposed on the frame back side.

6. A multi-use golf towel comprising:

a multi-layer towel comprising an absorbent front layer, a back layer being a chamois, and a moisture barrier inner layer disposed therebetween;

a frame attached within the towel, the frame comprising:

a frame top side disposed on the front layer;

a frame back side disposed on the back layer;

an outer perimeter;

at least one axle centrally disposed within the frame;

a pair of diametrically disposed indents disposed within the outer perimeter;

a brush removably rotatably within the frame;

a first side of the brush;

a second side of the brush opposite the first side;

wherein the brush first side and the brush second side are alternately exposed on the front layer;

a central pivot rod of the brush disposed between the first side and the second side of the brush, the central pivot rod having a pair of outer ends securingly engaging the indents and a central aperture rotatingly engaging the axle;

a cover disposed on the frame back side;

a plurality of wire bristles disposed on the entire first side; and a plurality of soft bristles disposed on the entire second side.

7. The multi-use golf towel of claim 6 further comprising:

a ring having a central hole therein, the ring continuously disposed through the front, back, and inner layers of the towel.

* * * * *